US011069965B2

(12) United States Patent
Wang et al.

(10) Patent No.: US 11,069,965 B2
(45) Date of Patent: Jul. 20, 2021

(54) LOW-PROFILE BROADBAND CIRCULARLY-POLARIZED ARRAY ANTENNA USING STACKED TRAVELING WAVE ANTENNA ELEMENTS

(71) Applicant: SOUTHEAST UNIVERSITY, Nanjing (CN)

(72) Inventors: Haiming Wang, Nanjing (CN); Qi Wu, Nanjing (CN); Jiexi Yin, Nanjing (CN); Chen Yu, Nanjing (CN); Wei Hong, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 0 days.

(21) Appl. No.: 16/626,541

(22) PCT Filed: Jan. 31, 2018

(86) PCT No.: PCT/CN2018/074772
§ 371 (c)(1),
(2) Date: Dec. 25, 2019

(87) PCT Pub. No.: WO2019/015298
PCT Pub. Date: Jan. 24, 2019

(65) Prior Publication Data

US 2020/0287277 A1 Sep. 10, 2020

(30) Foreign Application Priority Data

Jul. 18, 2017 (CN) ..... 201710583689.9

(51) Int. Cl.
*H01Q 1/38* (2006.01)
*H01Q 1/48* (2006.01)
(Continued)

(52) U.S. Cl.
CPC ..... *H01Q 1/38* (2013.01); *H01Q 1/48* (2013.01); *H01Q 1/50* (2013.01); *H01Q 21/24* (2013.01)

(58) Field of Classification Search
CPC .. H01Q 1/38; H01Q 1/48; H01Q 1/50; H01Q 21/24; H01Q 9/27; H01Q 21/0043
See application file for complete search history.

(56) References Cited

U.S. PATENT DOCUMENTS 10,170,839 B2 * 1/2019 Xue ..... H01Q 9/0428
2006/0119532 A1 6/2006 Yun et al.

FOREIGN PATENT DOCUMENTS

CN 204464476 U 7/2015
CN 105811102 A 7/2016
(Continued)

OTHER PUBLICATIONS

Li, Yue et al., Axial Ratio Bandwidth Enhancement of 60-GHz Substrate Integrated Waveguide-Fed Circularly Polarized LTCC Antenna Array, IEEE Transactions on Antennas and Propagation, Oct. 31, 2012, pp. 4619-4626, vol. 60, No. 10.
(Continued)

*Primary Examiner* — Daniel D Chang
(74) *Attorney, Agent, or Firm* — Bayramoglu Law Offices LLC

(57) ABSTRACT

A low-profile broadband circularly-polarized array antenna based on stacked traveling wave antenna elements, includes: a circularly-polarized antenna element composed of three segments connected in an end-to-end manner of metal layers printed on two sides of a dielectric slab and a metallized via connecting two layers; a 2×2 antenna sub-array composed of a metallized via cavity and four antenna elements; a 16-way full-parallel feeding network composed of the metallized vias; slots for coupled feeding between feeding layers and metal cavities and the antenna; and a switching structure for
(Continued)

testing between a grounded coplanar waveguide (GCPW) and a substrate integrated waveguide (SIW). An antenna array designed can be manufactured by using a printed circuit board process. The antenna array can realize circularly polarized radiation in a very broad frequency band.

7 Claims, 10 Drawing Sheets

(51) Int. Cl.
*H01Q 1/50* (2006.01)
*H01Q 21/24* (2006.01)

(56) References Cited

FOREIGN PATENT DOCUMENTS

| | | | | |
|---|---|---|---|---|
| CN | 106356612 | A | | 1/2017 |
| CN | 106505316 | A | | 3/2017 |
| CN | 107394381 | A | | 11/2017 |
| CN | 110190408 | A | * | 8/2019 |
| JP | S58134511 | A | | 8/1983 |

OTHER PUBLICATIONS

H. Nakano, et al., Wideband Curl Antenna, International Workshop on Antenna Technology, 2011, pp. 110-111.

* cited by examiner (a) (top view)

(b) (side view)

LOW-PROFILE BROADBAND CIRCULARLY-POLARIZED ARRAY ANTENNA USING STACKED TRAVELING WAVE ANTENNA ELEMENTS

CROSS REFERENCE TO THE RELATED APPLICATIONS

This application is the national phase entry of International Application No. PCT/CN2018/074772, filed on Jan. 31, 2018, which is based upon and claims priority to Chinese Patent Application No. 201710583689.9, filed on Jul. 18, 2017, the entire contents of which are incorporated herein by reference.

TECHNICAL FIELD

The present disclosure relates to a broadband circularly-polarized antenna array having wide application prospects manufactured by using printed circuit board (PCB) technology, and belongs to the field of antenna technology.

BACKGROUND

Antennas are an important part of wireless communication systems. The rapid development of wireless communications has created an urgent need for an antenna array with a small size, a low cost, a high gain, and a wider bandwidth.

Circularly polarized antennas can receive arbitrarily polarized electromagnetic waves from any antenna, which can effectively improve the reception and radiation efficiency. Therefore, they are widely used in practical interference and electronic reconnaissance. Circularly polarized antennas can be implemented by using various antenna forms such as a horn antenna, a microstrip antenna, or a cavity antenna. With the rapid development of modern wireless communications, there is a great demand for broadbandized low-profile circularly-polarized antenna arrays which are easy for planar integration, have unidirectional radiation and a high gain and can work in the millimeter wave band. However, the available bandwidth of the existing circularly-polarized planar array antennas processed by PCB printing and other forms usually does not exceed 17%, which is difficult to meet the increasing bandwidth requirements of the millimeter wave band.

SUMMARY

The objective of the invention is as follows. In view of the problems and deficiencies in the prior art, the present invention provides a low-profile broadband circularly-polarized array antenna using stacked traveling wave antenna elements, wherein a traveling wave antenna element using a stacked printed structure is used as an antenna element, the parameters are optimized under special boundary conditions, and the substrate integrated waveguide (SIW) technology is used to feed, realizing an 8×8 low-profile broadband circularly-polarized antenna array easy for plane integration and easy to design and process, which can meet the needs of wireless communication systems and can be applied to the microwave millimeter wave bands. SIW slot coupling is designed to feed the traveling wave antenna element of the stacked printed structure, and the parameters are optimized under the special boundary conditions to excite the required broadband circularly polarized radiation in the far field. By adding the matching metalized vias, T-junctions and H-junctions in the SIW feeding network are optimized to realize the broadbandization of feeding networks of the antenna. The antenna has the advantages such as directional radiation, low profile, broadband circular polarization, and high efficiency.

The technical solution is as follows. A low-profile broadband circularly-polarized array antenna using stacked traveling wave antenna elements, including: a dielectric slab of an antenna layer; 8×8 antenna elements printed, wherein the 8×8 antenna elements are on the dielectric slab of the antenna layer and composed of metal strips located on lower and upper surfaces of the dielectric slab and a metallized via connecting the metal strips; a dielectric slab for separating the antenna layer from a feeding network layer; full-parallel feeding networks composed of two layers of SIW feeding networks; and a GCPW-SIW switching structure for testing between a grounded coplanar waveguide (GCPW) and a SIW.

In the antenna layer, an antenna body is composed of the dielectric slab of the antenna layer, and the 8×8 antenna elements printed, wherein the 8×8 antenna elements are on the dielectric slab of the antenna layer and composed of the metal strips located on the lower and upper surfaces of the dielectric slab and the metallized via connecting the metal strips. Herein, each antenna element has a same shape, and a radiating portion of the antenna element is composed of three segments connected in an end-to-end manner of metal layers printed on two sides of the dielectric slab and a metallized via connecting two layers: metal strips with a fixed width and a trajectory being an Archimedes spiral line are divided in proportion, and are separately printed on the two sides of the dielectric slab, and a rectangular metal strip printed on a lower side of the dielectric slab and a Archimedes spiral line metal strip located on the same side are connected; two layers of the metalized strips are connected by the metalized via connecting the two layers to form the radiating portion of the antenna element. The formed antenna can realize broadband right-handed circularly-polarized radiation.

In the two layers of the feeding networks, an upper feeding network is composed of two layers of floors printed on the dielectric layer, 4×4 rectangular metal cavities composed of the metalized vias, and rectangular strip-shaped slots cut out from upper and lower surfaces of the floors. Herein, each rectangular metal cavity is composed of the metalized vias arranged along edges of a rectangle and the metallized vias arranged along a middle axis of two long sides; a lower feeding network feeds to the upper feeding network to excite the rectangular metal cavity by rectangular slot strips located at a center of the rectangular metal cavity cut out from a lower layer of the floors; and the rectangular metal cavity feeds to the antenna layer in an electromagnetic coupling manner by 2×2 rectangular slot strips located at an edge of the rectangular metal cavity cut out from the lower layer of the floors.

In the two layers of the feeding networks, a lower feeding network is composed of two layers of the floors printed on the dielectric layer, a 1-point-16-way SIW power divider composed of a plurality of the metalized vias, rectangular strip-shaped slots feeding to the upper feeding network cut out from an upper surface of the floors, and the GCPW-SIW switching structure for testing. Herein, the 1-point-16-way SIW power divider is composed of 3 T-junctions, 4 H-junctions, and a plurality of the metalized vias for impedance matching. Power distribution order is T-junction, T-junction, and H-junction A design process of the antenna element is as follows.

The metal strips with the fixed width and the trajectory being the Archimedes spiral line are divided in proportion and are separately printed on the two sides of the dielectric slab. The trajectory of the Archimedean spiral line follows the following formula in a polar coordinate system:

$$r=a_{sp}\phi \quad \text{(Formula 1)}$$

where r is a radius in polar coordinates, $\phi$ is an angle in polar coordinates, and $a_{sp}$ is a radius increment constant of the spiral line. A metal strip portion printed on an upper surface of the dielectric slab is an Archimedean spiral line with starting and end values that are $\phi_{st}$ and $\phi_{mid}$, respectively; and a metal strip portion printed on a lower surface of the dielectric slab is composed of two segments, i.e. an Archimedean spiral line with starting and end values that are $\phi_{mid}$ and $\phi_{end}$, respectively, and a rectangular metal strip for slot coupling. The metal strips on the two sides of the dielectric slab are connected through the metalized via to form the radiating portion of the antenna element of the stacked printed structure. The antenna element is fed through a slot of the feeding network layers, and a traveling wave characteristic is excited on the antenna element, realizing a circularly-polarized radiation characteristic within a broad frequency band.

An optimization process of the antenna element is as follows.

Periodic boundary conditions are applied to the dielectric layer including the antenna elements and a periphery of an air layer above the antenna to simulate an axial ratio and impedance characteristics of an array, and under this condition, antenna parameters are optimized by using simulation software.

The beneficial effects of the present invention are as follows. The present invention provided a broadband circularly-polarized antenna array of traveling wave antenna elements using a stacked printed structure, which includes a radiating portion of the circularly-polarized antenna element composed of three segments connected in an end-to-end manner of metal layers printed on two sides of a dielectric slab and a metallized via connecting two layers; a 2×2 antenna sub-array composed of a metallized via cavity and four antenna elements; a 16-way full-parallel feeding network composed of the metallized vias; slots for coupled feeding between feeding layers and metal cavities and the antenna; and a switching structure for testing between a grounded coplanar waveguide (GCPW) and a substrate integrated waveguide (SIW).

The present invention has the following advantages.

The antenna layer and two feeding layers of the antenna are separately printed on different dielectric slabs, and feeding is performed between the layers by slot coupling, and there is no physical connection therebetween. Therefore, it can be processed by a single-layer PCB process and then multi-layer slabs are bonded by an adhesive layer, which brings the advantages such as a planar structure, easy integration, and simple processing.

The traveling wave antenna element of the stacked printed structure applied to the antenna array can have directionally circularly-polarized radiation characteristics in a broad bandwidth, thus bringing the broadband circular polarization characteristics of the array.

DETAILED DESCRIPTION OF THE EMBODIMENTS

The present invention is further described below in combination with specific embodiments. It should be understood that these embodiments are only used to illustrate the present invention and not to limit the scope of the present invention. Various equivalent forms of amendments to the present invention by those skilled in the art after reading the present invention each fall within the scope defined by the appended claims of the present application.

According to the present invention, a broadband circularly-polarized antenna array of traveling wave antenna elements using a stacked printed structure is processed by a single-layer printed circuit board (PCB) process.

Figure 1:
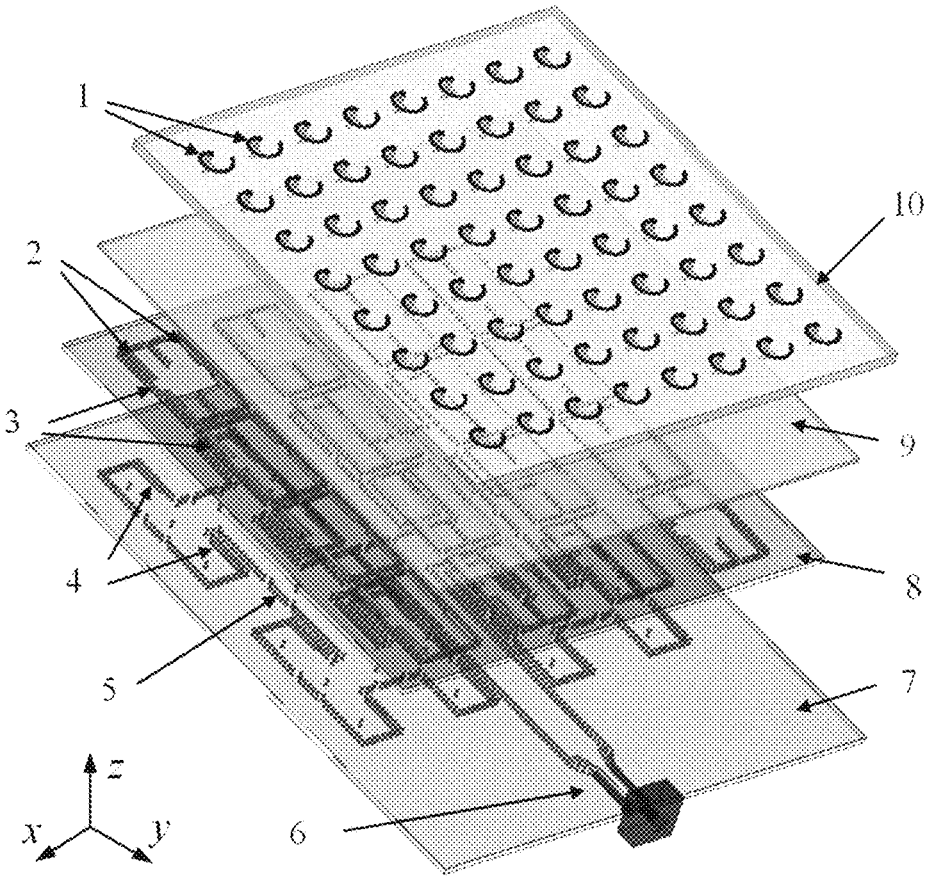
FIG. 1 is a schematic diagram showing a structure of an antenna array separated layer by layer according to the present invention.

FIG. 1 is a structure diagram of the antenna array separated layer by layer. The present invention includes the dielectric slab 10 of the antenna layer; 8×8 antenna elements 1 printed, wherein the 8×8 antenna elements 1 are on the dielectric slab 10 of the antenna layer and composed of the metal strips located on the lower and upper surfaces of the dielectric slab and the metallized vias connecting the metal strips; the dielectric slab 9 for separating the antenna layer from the feeding network layer; the feeding networks 7, 8 for full-parallel feeding composed of two layers of the substrate integrated waveguide (SIW) feeding networks; and the GCPW-SIW switching structure 6 for testing between the grounded coplanar waveguide (GCPW) and the SIW.

Figure 2:
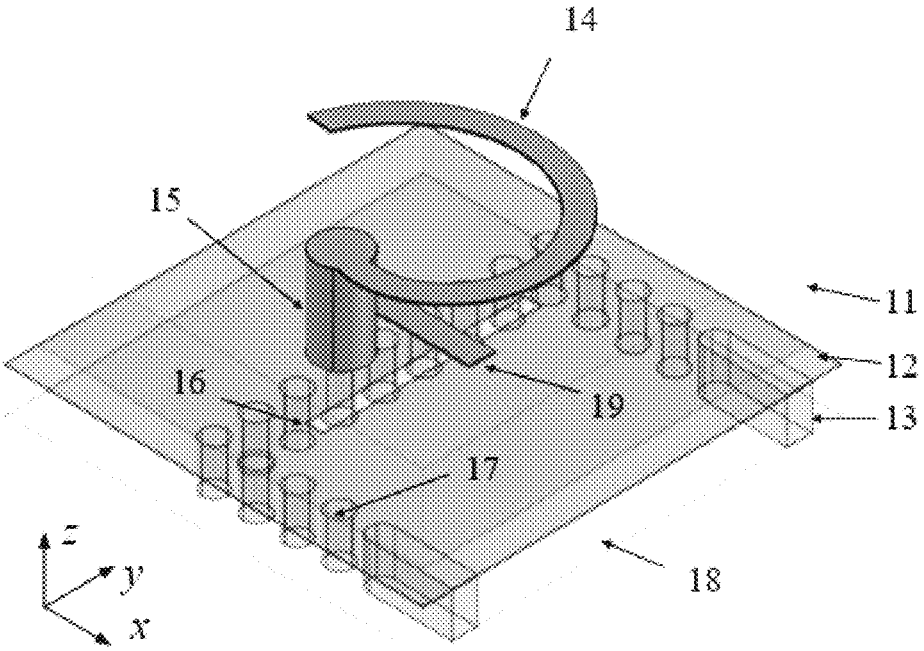
FIG. 2 is a schematic diagram of a three-dimensional structure of an antenna element according to the present invention.
Figure 3:
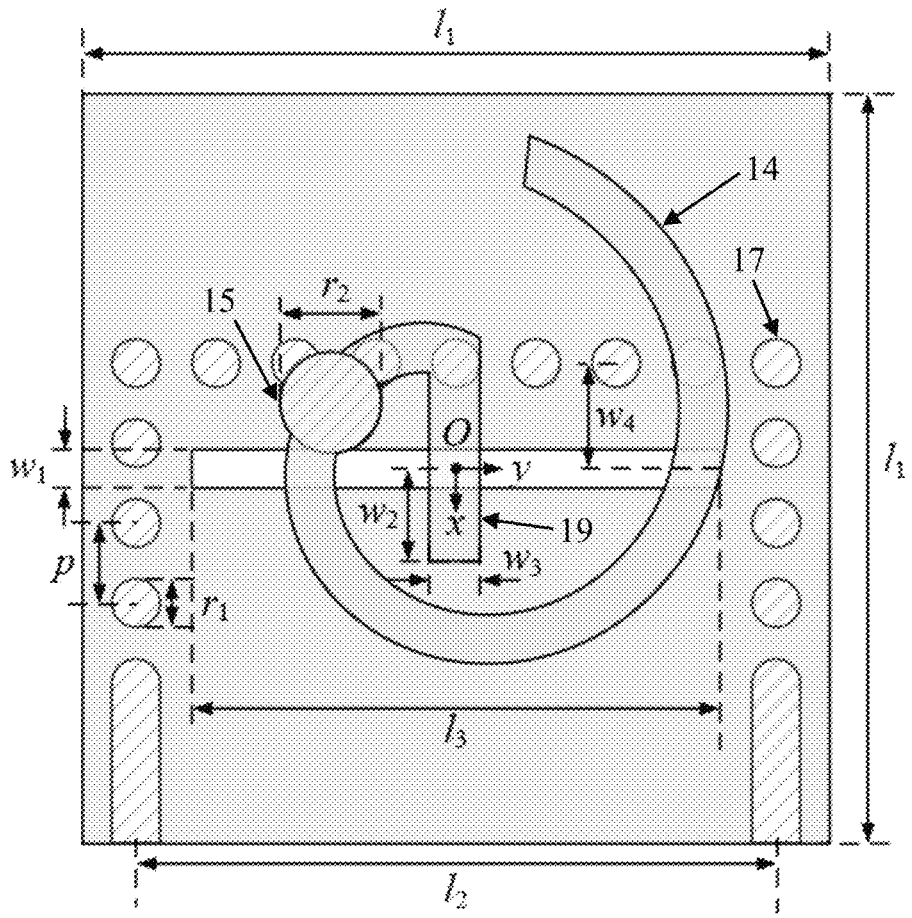
FIG. 3 shows a top view and a side view, and specific dimensions of the antenna element according to the present invention, wherein (a) is the top view, and (b) is the side view.
Figure 3:
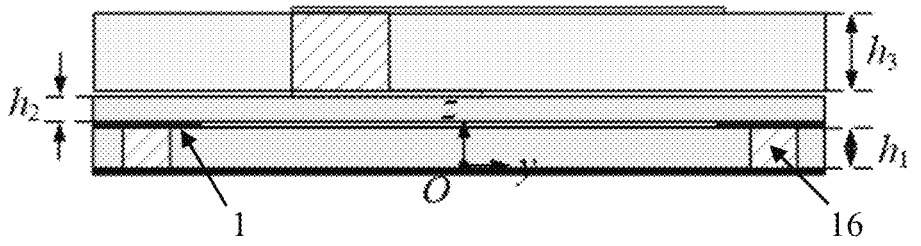

In the antenna layer, the antenna body is composed of the dielectric slab 10 of the antenna layer, and the 8×8 antenna elements 1 printed, wherein the 8×8 antenna elements 1 are on the dielectric slab 10 of the antenna layer and composed of the metal strips located on the lower and upper surfaces of the dielectric slab and the metallized vias connecting the metal strips. Herein, each antenna element 1 has the same shape. FIG. 2 is a schematic diagram showing a three-dimensional structure of the antenna element 1. The radiating portion of the circularly-polarized antenna element is composed of three segments connected in an end-to-end manner of two layers of the metalized strips 14, 19 printed on two sides of the dielectric slab 11 and the metallized via 15 connecting two layers; the metal strips with a fixed width and a trajectory being an Archimedes spiral line are divided in proportion, and are separately printed on the two sides of the dielectric slab, and the rectangular metal strip printed on the lower side of the dielectric slab and the Archimedes spiral line metal strip located on the same side are connected; the metalized strip 14 and the metalized strip 19 are connected by the metalized via 15 connecting two layers to form the radiating portion of the antenna element 1. The trajectory of the Archimedean spiral line follows the following formula in a polar coordinate system:

$$r=a_{sp}\phi \quad \text{(Formula 1)}$$

where r is a radius in polar coordinates, $\phi$ is an angle in polar coordinates, and $a_{sp}$ is a radius increment constant of the spiral line. The metal strip portion printed on the upper surface of the dielectric slab 11 is an Archimedean spiral line with the starting and end values that are $\phi_{st}$ and $\phi_{mid}$, respectively; and the metal strip portion printed on the lower surface of the dielectric slab 11 is composed of two segments which are an Archimedean spiral line with the starting and end values that are $\phi_{mid}$ and $\phi_{end}$, respectively, and a rectangular metal strip for slot coupling, respectively. A ratio of upper and lower Archimedean spiral line metal strips can be determined by defining a ratio parameter $r_{ul}=n_1/n_2$, where $n_1=\phi_{mid}-\phi_{st}$, and $n_2=\phi_{end}-\phi_{mid}$. An initial value of the ratio parameter may be selected as 4. The metal strips on the two sides of the dielectric slab 11 are connected through the metalized via 15 to form the radiating portion of the antenna element 1 of the stacked printed structure. The antenna element 1 is fed through the slot of the feeding network layers, and the travelling wave characteristic is excited on the antenna element 1, thereby realizing a circularly-polarized radiation characteristic within a broad frequency band. The formed antenna can realize broadband right-handed circularly-polarized radiation. In FIG. 2, the dielectric layer 12 is a dielectric slab that separates the antenna layer and the feeding network layer; the dielectric layer 13 is a dielectric layer where the SIW used for feeding is located; 16 is a slot for coupling feeding cut out from the upper metal layer of the SIW, the slot is rectangular, and the long side of the slot is perpendicular to the feeding direction of the SIW; and 17 is a metalized via forming the SIW. FIG. 3 (*a*) shows a top view and specific dimensions of the antenna element 1, and FIG. 3 (*b*) shows a side view and specific dimensions of the antenna element 1. Herein, $l_1$ is the side length of the dielectric slab of the antenna, $l_2$ is the width of the SIW feeder, $l_3$ is the length of the feeding slot 16, $w_1$ is the width of the feeding slot 16, $w_2$ is the length of the end of the lower-layer metal strip from the center of the antenna, $w_3$ is the width of the metal strip, $w_4$ is the distance from the center of the feeding slot 16 to the short-circuited end of the SIW feeder, $r_1$ is the diameter of the metalized via forming the SIW feeder, p is the pitch of the metalized vias, and $h_1$ is the height of the dielectric slab of the SIW feeder layer 18, $h_2$ is the height of the dielectric slab between the SIW feeder layer 18 and the antenna layer, and $h_3$ is the height of the dielectric slab of the antenna layer.

In the two layers of the feeding networks shown in FIG. 1, the upper feeding network 8 is composed of two layers of the floors printed on the dielectric layer, 4×4 rectangular metal cavities 3 composed of the metalized vias, and the rectangular strip-shaped slots 2 cut out from the upper and lower surfaces of the floors. Herein, each rectangular metal cavity 3 is composed of the metalized vias arranged along edges of the rectangle and the metallized vias arranged along the middle axis of two long sides; the lower feeding network feeds to the upper feeding network to excite the rectangular metal cavity 3 by the rectangular slot strips 4 located at the center of the rectangular metal cavity 3 cut out from the lower layer of the floors; and the rectangular metal cavity 3 feeds to the antenna layer in an electromagnetic coupling manner by 2×2 rectangular slot strips 2 located at the edge of the rectangular metal cavity 3 cut out from the lower layer of the floors.

In the two layers of the feeding networks, the lower feeding network is composed of two layers of the floors printed on the dielectric layer, the 1-point-16-way SIW power divider 5 composed of a plurality of the metalized vias, the rectangular strip-shaped slots 4 feeding to the upper feeding network cut out from the upper surface of the floors, and the GCPW-SIW switching structure 6 for testing. Herein, the 1-point-16-way SIW power divider is composed of 3 T-junctions, 4 H-junctions, and a plurality of the metalized vias for impedance matching. Herein, each of the T-junctions and H-junctions uses the metalized vias to improve their matching performance.

Figure 4:
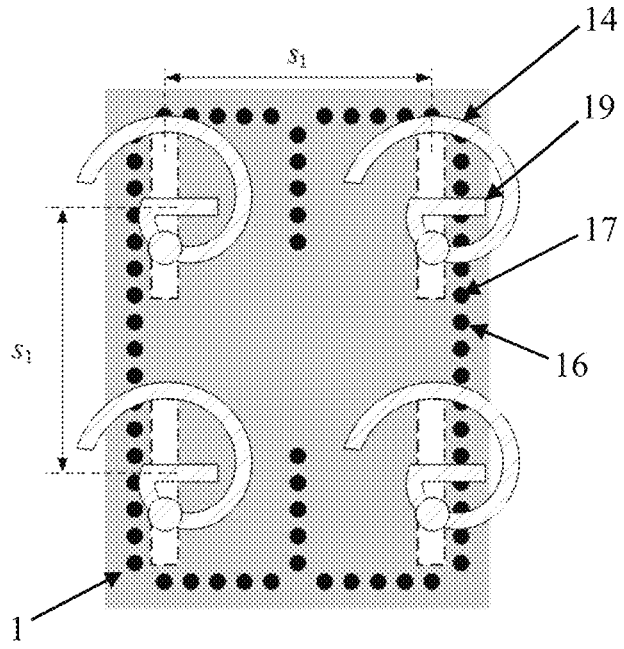
FIG. 4 is a partial schematic diagram of an antenna array according to the present invention, including a SIW rectangular cavity feeding and a rectangular slot cut on an upper surface of the rectangular cavity.
Figure 5:
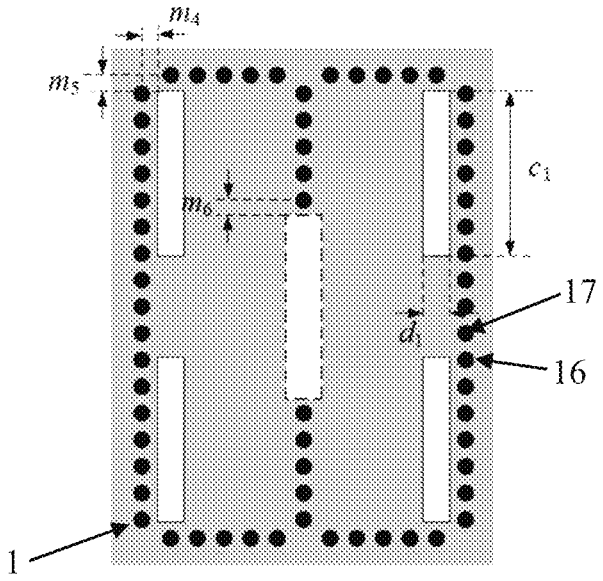
FIG. 5 is a partial schematic diagram of an antenna array according to the present invention, including a rectangular slot cut on an upper surface of a rectangular cavity and a rectangular slot on a lower surface of the rectangular cavity that excites the rectangular cavity.
Figure 6:
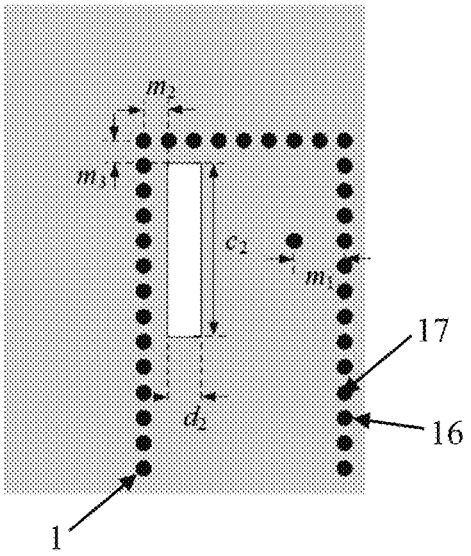
FIG. 6 is a partial schematic diagram of an antenna array according to the present invention, including a schematic diagram of a 1-point-16 feeding network at a lower layer feeding at an exit.

FIGS. 4-6 are partial schematic diagrams of an antenna array. FIG. 4 shows the uppermost antenna element, the SIW rectangular cavity feeding the uppermost antenna element, and the rectangular slot cut on the upper surface of the rectangular cavity; FIG. 5 shows the rectangular slot cut on the upper surface of the rectangular cavity and the rectangular slot on the lower surface of the rectangular cavity that excites the rectangular cavity; and FIG. 6 is a schematic diagram showing a 1-point-16 feeding network on the lower layer feeding at an exit. Wherein, $s_1$ is the pitch of the antenna elements, $c_1$ is the length of the rectangular slot feeding to the antenna, $d_1$ is the width of the rectangular slot feeding to the antenna, $c_2$ is the length of the rectangular slot feeding to the rectangular cavity, $d_2$ is the width of the rectangular slot feeding to the rectangular cavity, $m_1$ is the distance between the matching vias in the lower feeding network and the edge of the SIW feeder, $m_2$ and $m_3$ are the distance between the feeding slot in the lower feeding network and the edge of the SIW feeder, $m_4$ and $m_5$ are the distance between the feeding slot feeding to the antenna in the upper feeding network and the edge of the SIW rectangular cavity, and $m_6$ is the distance between the feeding slot feeding to the rectangular cavity in the upper feeding network and the via of the SIW rectangular cavity.

Figure 7:
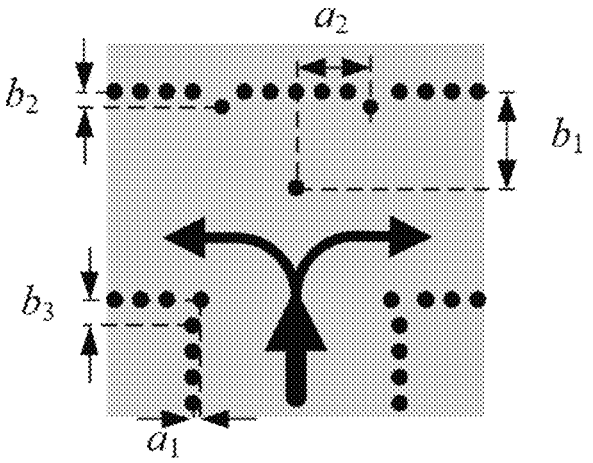
FIG. 7 is a schematic diagram showing a structure of a T-junction in a 1-point-16 feeding network of an antenna array according to the present invention.
Figure 8:
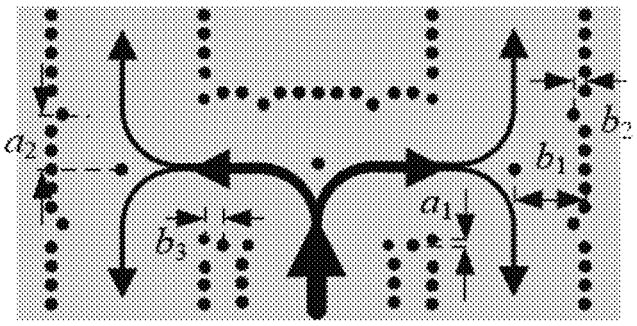
FIG. 8 is a schematic diagram showing a structure of an H-junction in a 1-point-16 feeding network of an antenna array according to the present invention.
Figure 9:
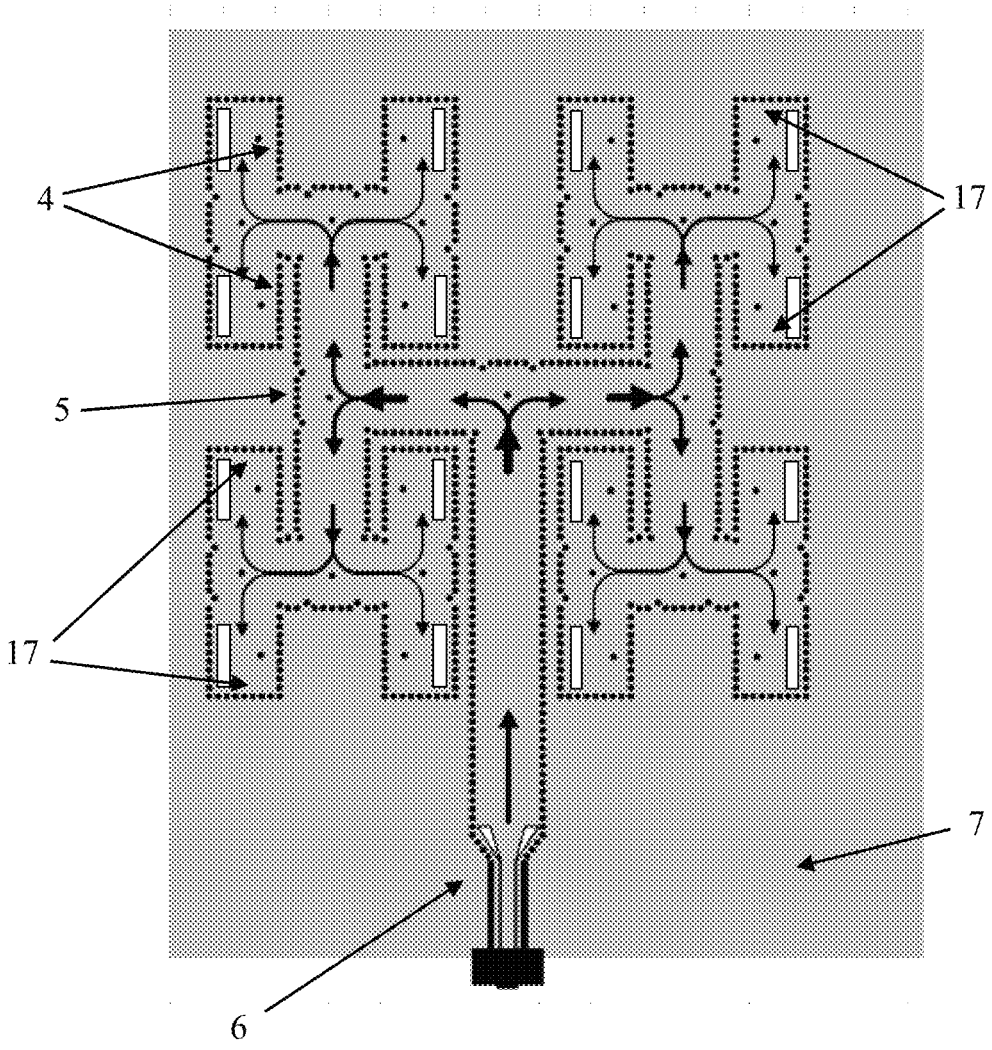
FIG. 9 is a schematic diagram of a 1-point-6-way feeding network of a lower layer of an antenna array according to the present invention.

FIGS. 7 and 8 are schematic diagrams showing a T-junction and an H-junction in the 1-point-16 feeding network, respectively. The black arrows represent the direction of power distribution. The T-junction and the H-junction consist of the metallized vias represented by the black circles. FIG. 9 is a schematic diagram of the lower 1-point-16-way feeding network, which consists of a SMA-GCPW-SIW switch, 3 T-junctions, and 4 H-junctions.

Periodic boundary conditions are applied to the dielectric layer including the antenna elements and the periphery of the air layer above the antenna to simulate an axial ratio and impedance characteristics of the array, and under this condition, antenna parameters are optimized by using simulation software to obtain antenna dimensional parameters shown in Table 1, wherein, $\varepsilon_r$ is a dielectric constant of the dielectric slab, and the meanings of the other parameters have been described above.

Figure 10:
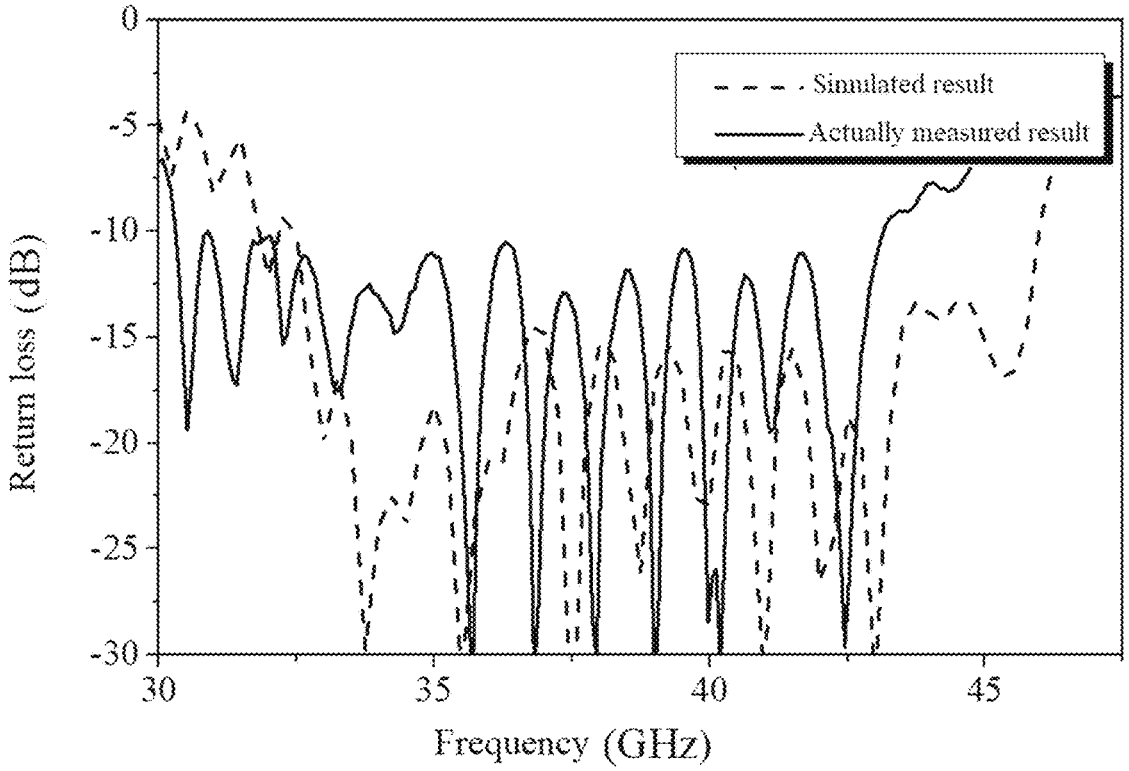
FIG. 10 is a schematic diagram showing a simulation and a actual measurement of a variation of a standing wave of an antenna array with frequency according to the present invention.
Figure 11:
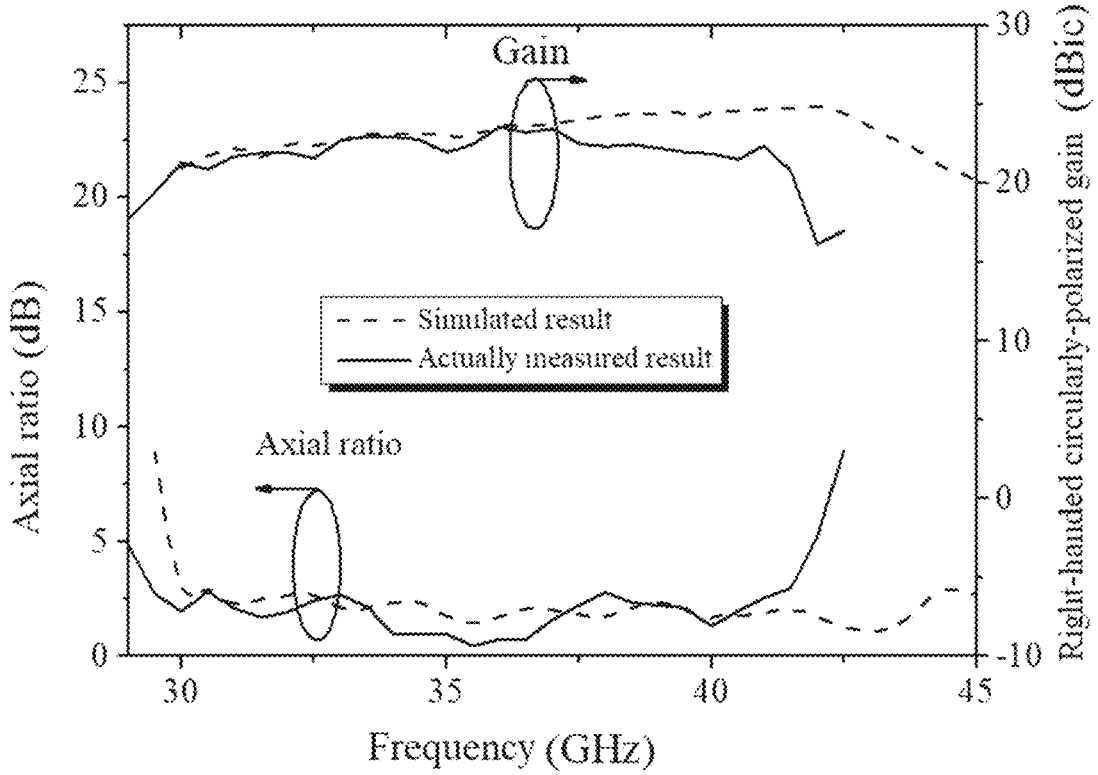
FIG. 11 is a schematic diagram showing a simulation and a actual measurement of a variation of an axial ratio and a gain of an antenna array with frequency according to the present invention.
Figure 12:
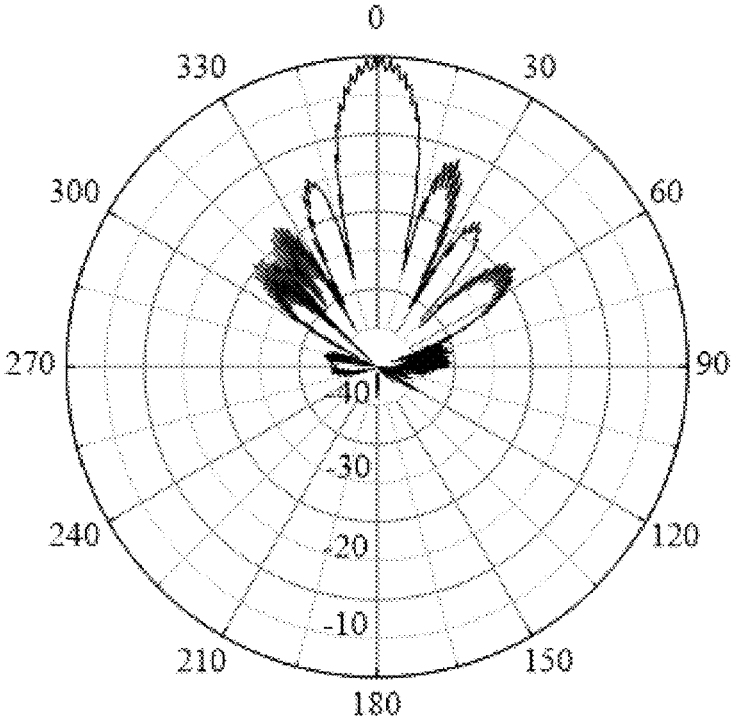
FIG. 12 is an actually measured axial ratio pattern of an XZ plane of an antenna array at 32 GHz according to the present invention.
Figure 13:
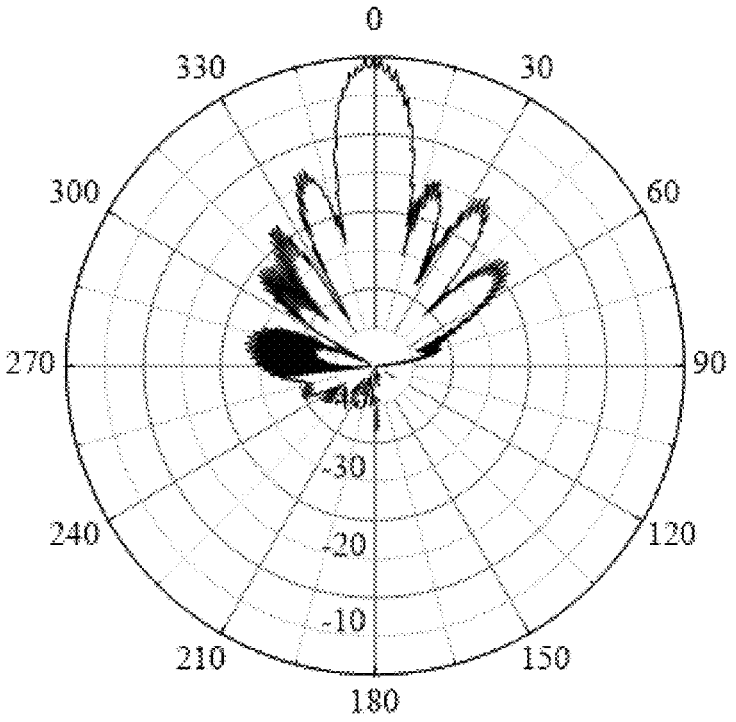
FIG. 13 is an actually measured axial ratio pattern of a YZ plane of an antenna array at 32 GHz according to the present invention.
Figure 14:
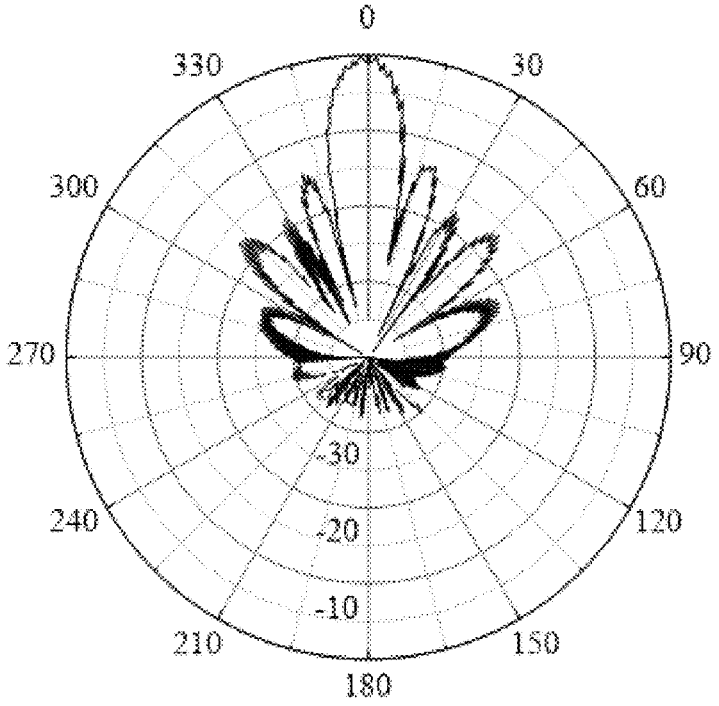
FIG. 14 is an actually measured axial ratio pattern of an XZ plane of an antenna array at 35 GHz according to the present invention.
Figure 15:
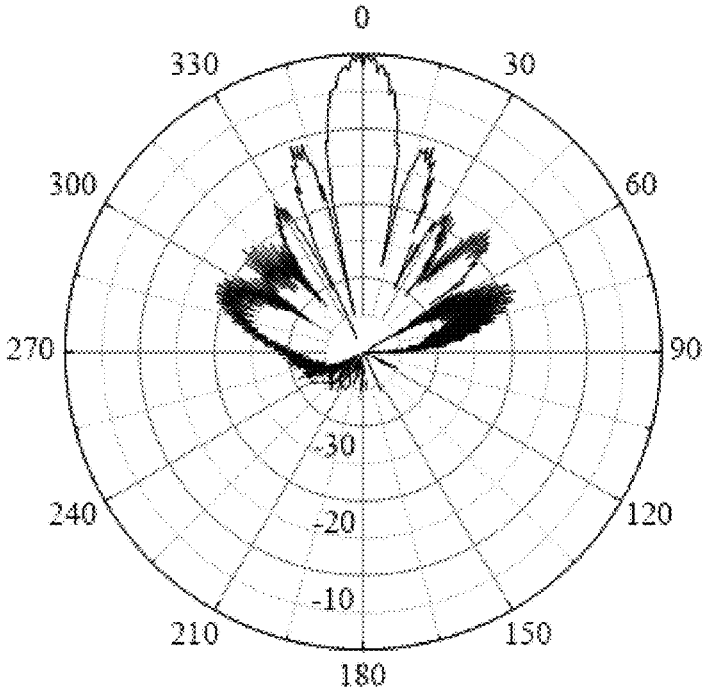
FIG. 15 is an actually measured axial ratio pattern of a YZ plane of an antenna array at 35 GHz according to the present invention.
Figure 16:
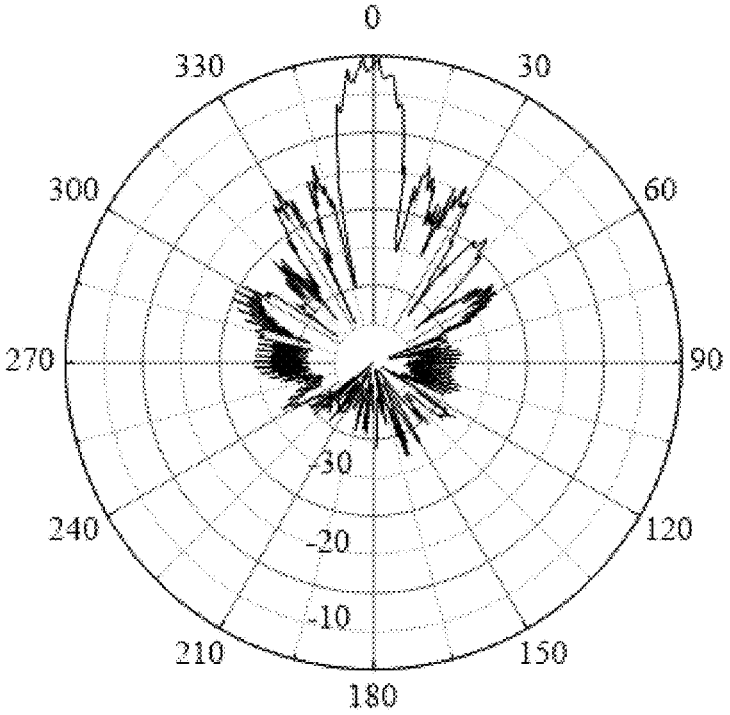
FIG. 16 is an actually measured axial ratio pattern of an XZ plane of an antenna array at 38 GHz according to the present invention.
Figure 17:
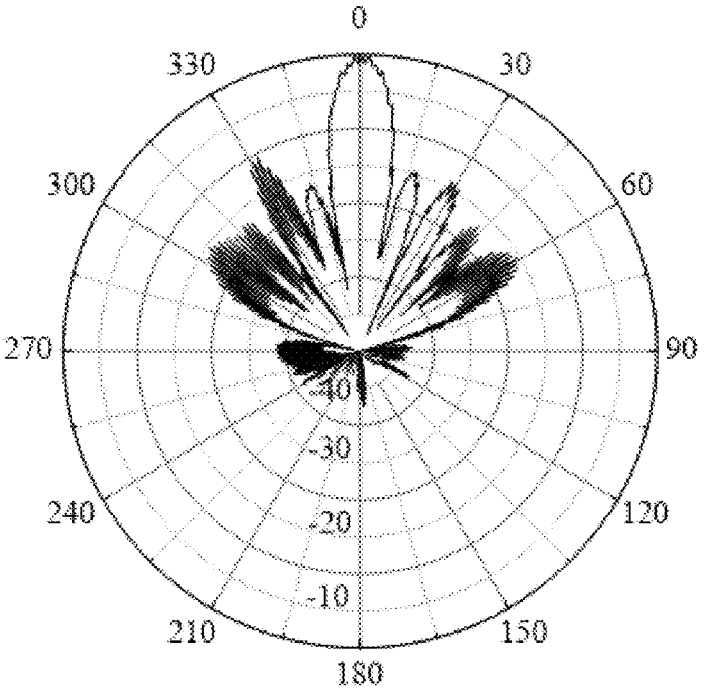
FIG. 17 is an actually measured axial ratio pattern of a YZ plane of an antenna array at 38 GHz according to the present invention.
Figure 18:
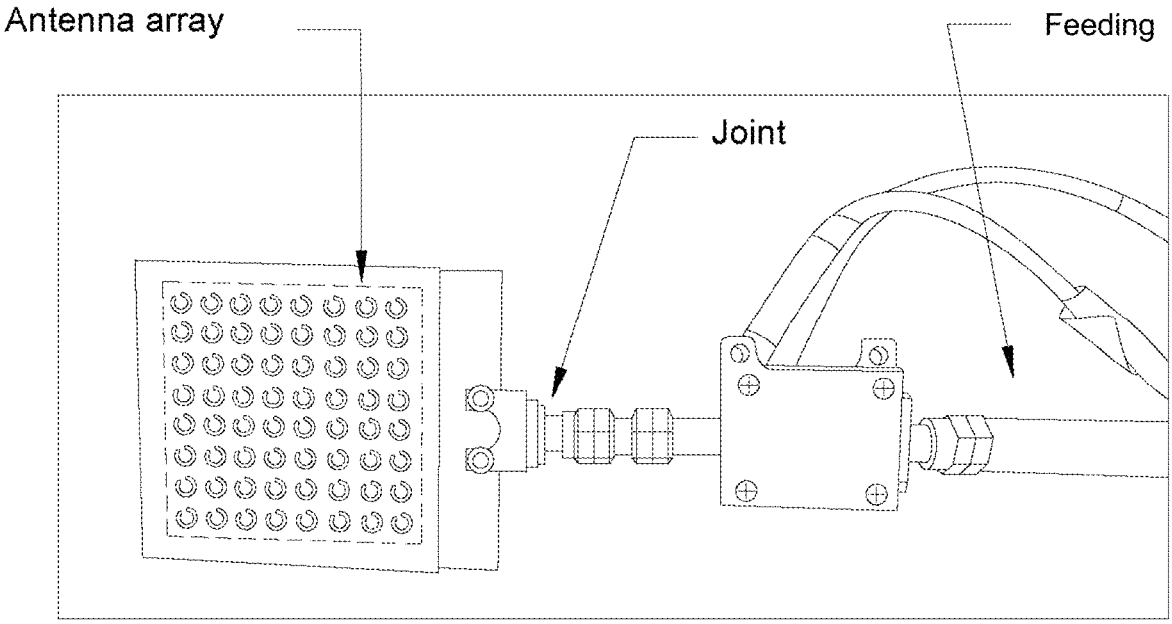
FIG. 18 is a real test picture according to the present invention.

FIG. 10 is a schematic diagram showing the simulation and the actual measurement of a variation of a standing wave of the antenna array with frequency according to the present invention. FIG. 11 is a schematic diagram showing the simulation and the actual measurement of a variation of an axial ratio and a gain of the antenna array with frequency according to the present invention. FIG. 12 is the actually measured axial ratio pattern of the XZ plane at 32 GHz according to the present invention; FIG. 13 is the actually measured axial ratio pattern of the YZ plane at 32 GHz according to the present invention; FIG. 14 is the actually measured axial ratio pattern of the XZ plane at 35 GHz according to the present invention; FIG. 15 is the actually measured axial ratio pattern of the YZ plane at 35 GHz according to the present invention; FIG. 16 is the actually measured axial ratio pattern of the XZ plane at 38 GHz according to the present invention; and FIG. 17 is the actually measured axial ratio pattern of the YZ plane at 38 GHz according to the present invention. FIG. 18 is a real test picture according to the present invention. It can be seen from the actually measured results that the designed broadband circularly-polarized antenna achieves a −10 dB impedance bandwidth of 35.4% (30.3 GHz to 43.4 GHz), a 3 dB axial ratio bandwidth of 33.8% (29.5 GHz to 41.5 GHz), a 3 dB gain bandwidth of 32.2% (30 GHz to 41.5 GHz) and a right-handed circularly-polarized peak gain of 23.53 dBic.

TABLE 1

| Parameter | Numerical Value (mm) | Parameter | Numerical Value (mm) |
|---|---|---|---|
| $l_1$ | 5.0 | $l_2$ | 4.0 |
| $l_3$ | 3.5 | $w_1$ | 0.6 |
| $w_2$ | 0.9 | $w_3$ | 0.3 |
| $w_4$ | 0.6 | $r_1$ | 0.3 |
| $r_2$ | 0.6 | p | 0.5 |
| $h_1$ | 0.508 | $h_2$ | 0.381 |
| $h_3$ | 1.016 | $a_{sp}$ | 0.2 |
| $\phi_{st}$ | 2.6 | $\phi_{mid}$ | 3.79 |
| $\phi_{end}$ | 8.63 | $s_1$ | 5.0 |
| $m_1$ | 1.4 | $m_2$ | 0.3 |
| $m_3$ | 0.3 | $m_4$ | 0.3 |
| $m_5$ | 0.3 | $m_6$ | 0.3 |

TABLE 1-continued

| Parameter | Numerical Value (mm) | Parameter | Numerical Value (mm) |
|---|---|---|---|
| $a_1$ | 0.157 | $a_2$ | 1.438 |
| $c_1$ | 3.5 | $c_2$ | 3.5 |
| $d_1$ | 0.6 | $d_2$ | 0.6 |
| $b_1$ | 1.846 | $b_2$ | 0.296 |
| $b_3$ | 0.503 | $\varepsilon_r$ | 2.2 |

What is claimed is:

1. A low-profile broadband circularly-polarized array antenna comprising:

a first dielectric slab of an antenna layer;

wherein the first dielectric slab of the antenna layer comprises stacked traveling wave antenna elements;

wherein the stacked traveling wave antenna elements comprises 8×8 antenna elements;

wherein the 8×8 antenna elements are printed on the first dielectric slab;

wherein each of the 8×8 antenna elements comprises a first and second metal strips located on lower and upper surfaces of the first dielectric slab, respectively, and a metallized via connecting the first and second metal strips;

a second dielectric slab for separating the antenna layer from a feeding network layer; which is part of two layers of substrate integrated waveguide (SIW) feeding networks;

wherein the two layers of SIW feeding networks comprise full-parallel feeding networks; and a grounded coplanar waveguide-substrate integrated waveguide (GCPW-SIW) switching structure for testing between a grounded coplanar waveguide and a SIW.

2. The low-profile broadband circularly-polarized array antenna as claimed in claim 1, wherein, in the antenna layer, an antenna body is composed of the first dielectric slab of the antenna layer, and the 8×8 antenna elements, wherein the 8×8 antenna elements are printed on the first dielectric slab of the antenna layer and composed of the metal strips located on the lower and upper surfaces of the first dielectric slab and the metallized via connecting the metal strips.

3. The low-profile broadband circularly-polarized array antenna as claimed in claim 2, wherein, each of the 8×8 antenna elements has a same shape; a radiating portion of a circularly-polarized antenna element is composed of three segments connected in an end-to-end manner, a first and a second segments being metal strips printed on the lower and the upper surfaces of a third dielectric slab, respectively, and a metallized via connecting the first and the second metal strips; metal strips with a fixed width and a trajectory being an Archimedes spiral line are divided in proportion, and are printed on the lower and the upper surfaces of the third dielectric slab, and a rectangular metal strip printed on a lower surface of the third dielectric slab and an Archimedes spiral line metal strip located on the upper side of the third dielectric slab are connected; the metal layers printed on the lower and the upper surfaces of the third dielectric slab are connected by the metalized via connecting the two layers to form the radiating portion of the circularly-polarized antenna element; and a formed antenna realizes broadband right-handed circularly-polarized radiation.

4. The low-profile broadband circularly-polarized array antenna as claimed in claim 1, wherein, in the two layers of the SIW feeding networks, an upper feeding network is composed of a first and a second metal strip printed on the first dielectric layer, 4×4 rectangular metal cavities composed of a plurality of metalized vias, and a first rectangular strip-shaped slot is cut out from upper and lower surfaces of the first and the second metal strips; wherein each of the 4×4 rectangular metal cavities is composed of the metalized vias arranged along each edge of the rectangle metal cavity and the metallized vias arranged along a middle axis of two long sides of the rectangular cavity; a lower feeding network feeds to the upper feeding network to excite each of the 4×4 rectangular metal cavities by rectangular slot strips located at a center of each of the rectangular metal cavities cut out from a lower surface of the first and the second metal strips; and the 4×4 rectangular metal cavities feed to the antenna layer in an electromagnetic coupling manner by 2×2 rectangular slot strips located at an edge of the rectangular metal cavities cut out from the lower surface of the first and the second metal strips.

5. The low-profile broadband circularly-polarized array antenna as claimed in claim 1, wherein, in the two layers of the SIW feeding networks, a lower feeding network is composed of a first and a second metal strip printed on the second dielectric layer, a 1-point-16-way SIW power divider composed of a plurality of the metalized vias, second rectangular strip-shaped slots feeding to the upper feeding network cut out from an upper surface of the first and the second metal strips, and the GCPW-SIW switching structure for testing; wherein the 1-point-16-way SIW power divider is composed of 3 T-junctions, 4 H-junctions, and a plurality of the metalized vias for impedance matching.

6. The low-profile broadband circularly-polarized array antenna as claimed in claim 1, wherein, a design process of each antenna element of the 8×8 antenna elements is as follows:

the metal strips with the fixed width and the trajectory being the Archimedes spiral line are divided in proportion and are separately printed on the lower and the upper surfaces of the first dielectric slab; and the trajectory of the Archimedean spiral line follows the following formula in a polar coordinate system:

$$r=a_{sp}\phi \quad \text{(Formula 1)}$$

where r is a radius in polar coordinates, $\phi$ is an angle in polar coordinates, and $a_{sp}$ is a radius increment constant of the spiral line; a metal strip portion printed on the upper surface of the first dielectric slab is an Archimedean spiral line with starting and end values that are $\phi_{st}$ and $\phi_{mid}$, respectively; and a metal strip portion printed on the lower surface of the first dielectric slab is composed of two segments, i.e. an Archimedean spiral line with starting and end values that are $\phi_{mid}$ and $\phi_{end}$, respectively, and a rectangular metal strip for slot coupling; the metal strips on the lower and the upper surfaces of the first dielectric slab are connected through the metalized via to form the radiating portion of the each antenna element of a stacked printed structure; the each antenna element is fed through a slot of the feeding network layer, and a traveling wave characteristic is excited on the each antenna element, realizing a circularly-polarized radiation characteristic within a broad frequency band.

7. The low-profile broadband circularly-polarized array antenna as claimed in claim 1, wherein the 8×8 antenna elements are optimized as follows:

periodic boundary conditions are applied to the first dielectric layer including the 8×8 antenna elements and a periphery of an air layer above the array antenna to simulate an axial ratio and impedance characteristics of the array antenna, and under this condition, antenna dimensional parameters are optimized.

* * * * *